US006666385B1

(12) United States Patent
Gonitzke et al.

(10) Patent No.: US 6,666,385 B1
(45) Date of Patent: Dec. 23, 2003

(54) PLURAL COMPONENT STRIPING SPRAY SYSTEM AND METHOD

(76) Inventors: John Gonitzke, 904 Eagle Ridge Rd., Billings, MT (US) 59101; David E. Graves, 2328 Elm St., Billings, MT (US) 59101

( * ) Notice: Subject to any disclaimer, the term of this patent is extended or adjusted under 35 U.S.C. 154(b) by 0 days.

(21) Appl. No.: 09/637,065

(22) Filed: Aug. 11, 2000

Related U.S. Application Data

(63) Continuation of application No. 09/234,877, filed on Jan. 21, 1999, now Pat. No. 6,102,304.

(60) Provisional application No. 60/072,341, filed on Jan. 23, 1998.

(51) Int. Cl.[7] ..... B05B 1/24

(52) U.S. Cl. ..... 239/130; 239/131; 239/133; 239/134; 239/135; 239/147; 239/172; 239/433

(58) Field of Search ..... 239/128, 130, 239/131, 133, 134, 135, 146, 147, 155, 172, 433

(56) References Cited

U.S. PATENT DOCUMENTS 3,046,854 A 7/1962 Wilson
3,049,439 A 8/1962 Coffman
3,057,273 A 10/1962 Wilson
3,083,913 A * 4/1963 Coffman et al.
3,682,054 A 8/1972 Mac Phail et al.
3,820,718 A * 6/1974 Ammon ..... 239/135
3,824,364 A * 7/1974 Cachat ..... 239/135
4,196,854 A * 4/1980 Prucyk ..... 239/130
5,225,239 A 7/1993 Ostin

* cited by examiner

*Primary Examiner*—Christopher Kim
(74) *Attorney, Agent, or Firm*—Nixon Peabody LLP; Donald R. Studebaker

(57) ABSTRACT

The plural component striping spray system and method involves mixing two spray components by pumping them under pressure from heated supply systems and converting them into a fine spray within a spray gun where they mix by impingement before being blown out through a common spray tip orifice. The initiation and termination of spray from the spray tip is controlled by a shutoff needle, and the design of the mixing chamber, needle and spray tip are such that no mixed material is allowed to stay in the spray gun to cure and freeze up the gun. When the components are a resin and a catalyst, pure catalyst is the first and last material sprayed from the spray gun.

The system includes a recirculation system which can become operative when the operation of the spray gun is terminated. This recirculation system is actually a spray simulator, duplicating the heat, pressures and flows that would exist in actual spraying, and the material from the recirculation system is recirculated back into the supply system, blending with the material in the entire system. The operator monitors the system in recirculation mode and indicators are provided to monitor spray component parameters as these components pass through restrictor orifices in the recirculation system.

10 Claims, 2 Drawing Sheets

PLURAL COMPONENT STRIPING SPRAY SYSTEM AND METHOD

This application is a continuation of U.S. application Ser. No. 09/234,877 filed Jan. 21, 1999, now U.S. Pat. No. 6,102,304 which is a continuation in part application of provisional application Ser. No. 60/072,341 filed Jan. 23, 1998.

TECHNICAL FIELD

The present invention relates generally to a system and method for spray painting pavement lines, and more particularly to and improved spray system and method for spray painting pavement lines with a plural component spray.

BACKGROUND ART

Plural component road marking systems consist of a resin or resinous material as being one component and a catalyst, (reactor—hardener) being the other component. To complete the system a third component, the reflective agent, which may also be made up of one or more components, is added, usually as a secondary operation to the spraying of the resin and catalyst. The two components, i.e., the resin and the catalyst must be brought together in a given ratio to facilitate the curing, hardening, of the material once applied. It is crucial that the mix of the two components be thorough, complete and accurate. Failure to achieve a thorough and proper mix, will result in various application failures, ranging from partial to full failures. An uncured line will not adhere to the road surface, leaving the roadway unmarked. In the interim moving traffic will track the uncured material indiscriminately across the road surface. The material will also be splashed onto auto finishes and glass areas causing considerable and expensive damage to autos. Improper curing because of improper application will also result in various failures. In addition to the hazards presented by a failed line, the correction is expensive and time consuming.

Slower drying materials require the use of traffic barriers to prevent moving traffic from tracking through slowly curing lines. These barriers may be a follow vehicle with warnings to traffic behind the striper to not pass or come between the striper and follow vehicle and the placement of traffic cones beside the new line to warn traffic not to come into the line. These traffic inhibitors are dangerous to both the motorist and workers and are the cause of many accidents resulting in death and serious injuries.

Newer developments in materials over the last few years have presented additional problems in the application and use of multiple component marking systems. To reduce some of the previous mentioned problems, primarily associated with slower cure times, faster curing materials such as those disclosed in U.S. Pat. No. 5,478,596 Richard S. Gurney have been developed. Some of the materials developed and certainly those to be developed in the future, set so fast, that the standard static mixing tube applicator system will no longer work. For clarification, a static mixing tube system relies on the resin and catalyst being physically mixed together by forcing the two materials together as they are flowed through a common tube with intermittent flow restrictors inside the tube, thereby causing the materials to "twist" together. This system is archaic, and in fact insures that there will be at least parts of the application that will be improper. The two materials do not like each other and tend to resist mixing. In addition, this system requires frequent flushing with solvents to keep the system operational, (if not flushed, the mixed materials in the tube cake cure and block the tube). The solvents are not environmentally safe and by Federal and state laws are prohibited from being 'dumped' on the ground. The solvents also degrade the road surface in the case of composite roads, by dissolving the tars holding the composite together, and causing the road to disintegrate. These solvents are poisonous and dangerous to humans and animals.

Many factors affect the final result, i.e., the materials meeting the road surface in the correct ratio and properly mixed to achieve cure as prescribed by the formula, slow enough to allow the injection of a reflective media prior to cure, fast enough to keep the reflective media from sinking to the bottom and being covered by the material; the definition of the line dimensionally and physically, being of proper width, thickness, uniformity, edge definition and square start and finish.

The considerations that must be given within a multi component spray system are factors governed by the characteristics of the material components. The component materials, rate of flow and the nature in which it flows as well as the various variables that enhance or inhibit the flow of the materials, including ambient heat, heat caused by flow, friction and resistance. Size of hose and pipe, valves, orifices, turns and radii all have an impact on the movement of the material components from a supply tank to the spray tip. The material components must arrive at the mix chamber and flow into the mix chamber in the exact ratio required to achieve the desired result. The two components do not have the same characteristics of flow at the same temperature and a line spray system operates in an environment that is unpredictable, that is outdoor weather has many variables that impact the temperature gain or loss of the material at various points in the system. A warm day with a high wind can cause heat loss that would be more severe than a cooler day with no wind.

It is imperative that when a line spray system is activated and material is sprayed from the gun, that all systems are in synchronous harmony to assure a perfect line at each start. With archaic systems, the only way this could be accomplished was to actually place a bucket under the gun and activate the gun until the system was producing materials in the correct proportion to cure. This was wasteful, time consuming and only a viable solution for a start-up, with no assurance that for temporary delays, such as a long wait at an intersection, that the gun did not freeze-up, or have an improper mix.

SUMMARY OF THE INVENTION

It is a primary object of the present invention to provide a novel and improved plural component striping spray system which effectively mixes the components by impingement prior to spraying.

Another object of the present invention is to provide a plural component striping spray system and method which mixes by impingement a resin and a catalyst under pressure in a spray gun mixing chamber prior to the spraying of the mixture through a spray nozzle. The spray gun and spray shutoff system for the spray gun is formed such that a minute amount of catalyst without resin exits the spray nozzle when spraying is initiated and terminated.

A further object of the present invention is to provide a plural component striping spray system and method wherein the components are brought to substantially the same viscosity before being mixed by impingement in a spray gun.

Yet another object of the present invention is to provide a plural component striping spray system and method wherein a spray gun for the system includes a restricted input orifice for each of the components and a recirculation system is provided to circulate each component through a restricted orifice remote from the spray gun and back to a supply tank when the spray gun is shut down. The remote restricted orifice for each component matches the restricted orifice for that component in the spray gun, and the pressure for the component is measured at the remote restricted orifice to determine component viscosity. The temperature of the components is then adjusted until the component viscosities are substantially equal.

A still further object of the present invention is to provide a plural component striping spray system which includes component storage tanks with internal temperature control mixing paddles.

These and other objects are achieved by providing a system wherein plural components are mixed by pumping them under pressure from heated supply systems and converting them into a fine spray within a spray gun where they mix by impingement within a spray gun mixing chamber before being blown out through a common spray tip orifice. The initiation and termination of spray from the spray tip is controlled by a shutoff needle, and the design of the mixing chamber, needle and spray tip are such that no mixed material is allowed to stay in the spray gun to cure and freeze up the gun.

The high pressure pumps used in the system are a stroking type pump, and therefore when the pumps change direction there is a fraction of time that the pump stops to reverse direction. At each change of direction a pulse is created in the material flow. The system alleviates this pulse problem by the use of accumulators that store up material at pressure and at the point of pump interruption provide a smooth material flow.

The flow of the materials is affected considerably by small changes in temperature, therefore the system incorporates the use of heat sources within the material tank that allows the material to flow through the heat source and provide a uniform temperature throughout the material. This system also facilitates the heating of material at a faster rate allowing for system operation at faster speeds and discharge rates.

The spray gun is heated to maintain temperature control up to exit of material. The material components are brought to the spray gun mixing chamber from opposing sides at high pressure and through a small input orifice intensifier. The chamber is made from a high wear resistance material to resist the erosive characteristics of the abrasive resins traveling through at high pressure and speed. Each input orifice is precision manufactured to maintain accuracy of mix. The orifices are matched to the flow and size of the tip to ensure proper back pressure ahead of the tip and force mixing to take place within the chamber assuring that mixed material exits the spray gun. The input orifices are also offset, with the orifice for catalyst being slightly lower than the resin orifice. This feature causes the catalyst to be the first input orifice to open and the last input orifice to be closed off by the needle action, which means that there never is resin only exiting from the tip which would, at the start or end of a sprayed line, leave an uncured spot or defect.

The system includes a recirculation system which becomes operative when the operation of the spray gun is terminated. This recirculation system is actually a spray simulator, duplicating the heat, pressures and flows that would exist in actual spraying, and the material from the recirculation system is recirculated back into the tank and storage system, blending with the material in the entire system. This prevents overheating of a small amount of material as well as assuring that the monitored material in this cycle is representative of the whole. The operator monitors the system in recirculation mode and when the indicators and gauges show that the system is in harmony, the operator is assured that when he opens the spray gun that the material mixture exiting is correct. Continuous monitoring while operating also tells the operator when something in the system has changed that would allow an improper mix material to be applied. The operator would have warning to shut the system down thereby preventing costly errors. This monitoring could be enhanced with audible and/or visual warning alarms.

DESCRIPTION OF THE PREFERRED EMBODIMENT

Figure 1:
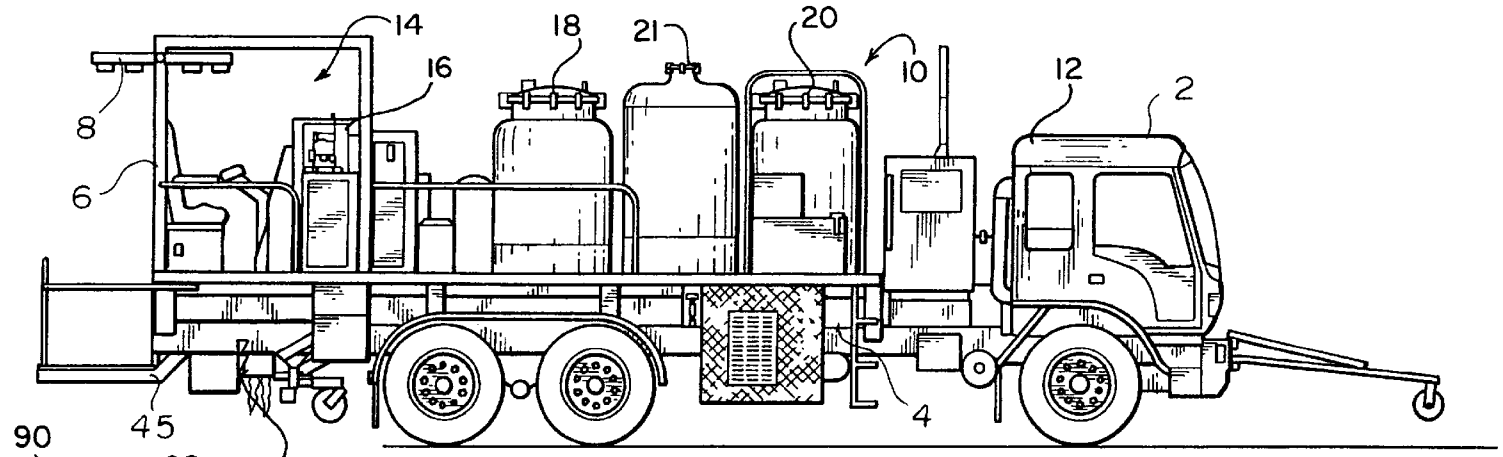
FIG. 1 is a view in side elevation of a truck carrying the plural component spray system of the present invention.

Referring now to FIGS. 1 to 5, the plural component striping spray system of the present invention indicated generally at 10 is mounted on a spray truck 12 having cab 2 at the forward end, a support platform 4 extending from the cab to the rear end, and a spray operator station 14 mounted on the support platform at the rear end with a control console 16 for the system 10. A frame 6 extends above the support platform behind the console 16 The plural component striping spray system 10 includes an insulated resin material tank 18 and an insulated catalyst tank 20. The terms "resin" and "catalyst" are used herein for descriptive purposes to describe the many types of components which can be combined to form a two component striping composition, such as polyisocyanates which react with polyols. If retro reflective media are used, they are provided in a tank 21. The resin and catalyst tanks are externally heated by a heat exchange medium, such as glycol, provided by a heat generator 22. This heat generator may include a furnace, boiler or other device with a heat source to heat a heat exchange medium which is then pumped by a pump 24 to system components to be heated. Heated glycol is pumped by the pump 24 over an output line 26 to heat exchangers (not shown) surrounding the resin tank 18 and the catalyst tank 20 and is then returned to the heat generator 22 for reheating by a return line 28. Also, heated glycol is provided by the pump 24 to a catalyst heat exchanger 30 and a resin heat exchanger 32 over a heat exchanger output line 34. After the glycol gives up heat in the heat exchangers 30 and 32, it is returned to the heat generator for reheating over a heat exchanger return line 36.

A high pressure catalyst pump 38 pumps catalyst from the insulated catalyst tank 20 through the catalyst heat exchanger 30 and into a catalyst accumulator 40. From the catalyst accumulator, the catalyst is pumped under pressure by the catalyst pump through a catalyst filter 42 and then to a spray gun 44. Similarly, the resin is pumped by a plurality of high pressure resin pumps 46 from the insulated resin material tank 18 and the resin heat exchanger 32 to a resin accumulator 48. Then resin under pressure is pumped by the resin pumps 46 desirable for the viscosity of the resin and catalyst to be substantially equal when they enter the mixing chamber 70. Unfortunately, the two materials reach equal viscosity at different temperatures, and therefore temperature control of the heat exchangers 30 and 32 as well as heated tanks 18 and 20 is important. It is necessary to ascertain that the resin and catalyst are of the proper temperature and viscosity before they are mixed and sprayed.

Figure 2:
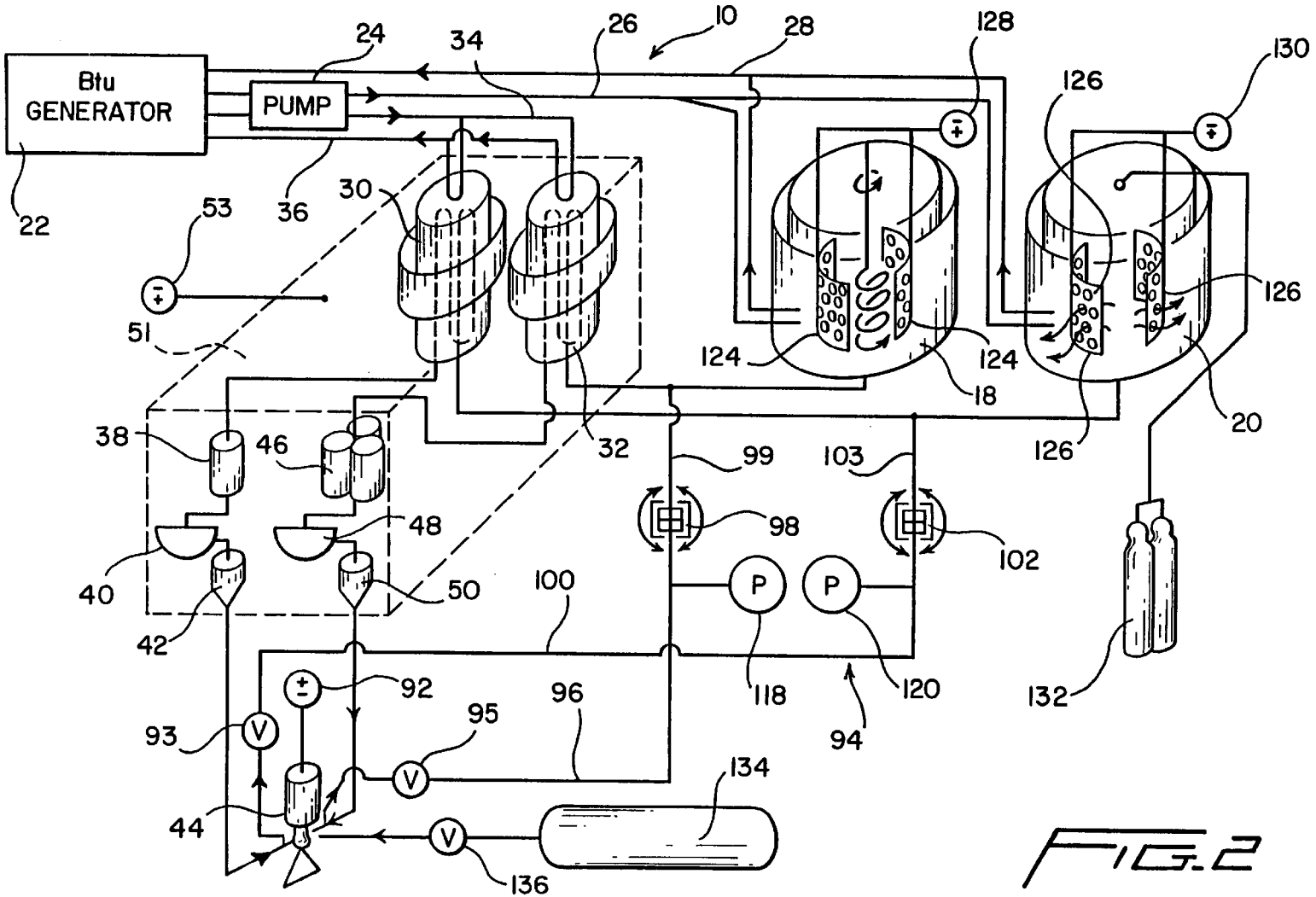
FIG. 2 is a diagram of the plural component spray system of the present invention.

It should be noted that each of the resin pumps 46 is exactly equal in size and capacity to the catalyst pump 38, and in this manner, the ratio of catalyst to resin is determined. If the ratio of catalyst to resin is 1 to 3, then three resin pumps 46 are used for one catalyst pump as shown in FIG. 2. If the ratio is 1 to 2, then only two resin pumps would be used. Each of the resin pumps may be connected by a separate line to a separate resin heat exchanger 32 (one for each pump) and by separate lines to the insulated resin material tank 18. However, the outputs of all resin pumps are fed to the resin accumulator 48 and then through the resin filter 50. Of course, the resin heat exchanger and the lines from the insulated resin material tank may be of sufficient size so that a single line supplies all of the resin pumps.

Other ways of varying the ratio of catalyst to resin can obviously be used. For example, different size pumps can perform this function. A single resin pump 46 having three times the capacity of the catalyst pump 38 could be used to create the 1 to 3 ratio. It should be noted that catalyst from the catalyst tank and resin from the resin material tank are supplied from the bottom and return to the top of the respective tanks to prevent foaming.

The high pressure pumps 38 and 46 are stroking type pumps and not pumps which provide a continuous uninterrupted motion. Therefore when each pump changes direction there is a minute period of time when the pump stops to reverse direction. At each change of direction, a pulse is created in the material flow provided by the pump which is virtually undetectable. However at the ground operating speed of the spray truck 12, this fraction of interrupted flow results in a narrowing of the applied line on the road surface; a phenomenon known as "hourglassing." To prevent hourglassing, the two component spray system 10 uses the catalyst accumulator 40 and the resin accumulator 48 to store material at pressure so at the point of associated pump interruption, the accumulator will continue to provide material at pressure to the spray gun 44.

The heat exchangers 30 and 32, the pumps 38 and 46, the accumulators 40 and 48 and the filters 42 and 50 are enclosed in a temperature controlled, insulated enclosure 51 which is environmentally controlled by a temperature source 53.

The construction of the spray gun 44 is unique and significantly contributes to effective mixing of the resin and catalyst components into a quick curing striping material. In the spray gun 44, an impingement mixing method is used to provide a very thorough and complete mix of the two components. The resin and catalyst are mixed in the spray gun by bringing them together in a fine spray under high pressure and at great force.

Figure 4:
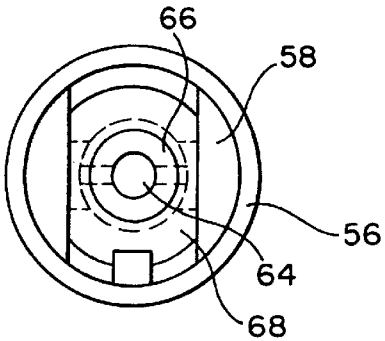
FIG. 4 is a sectional plan view of the spray gun of FIG. 3.
Figure 3:
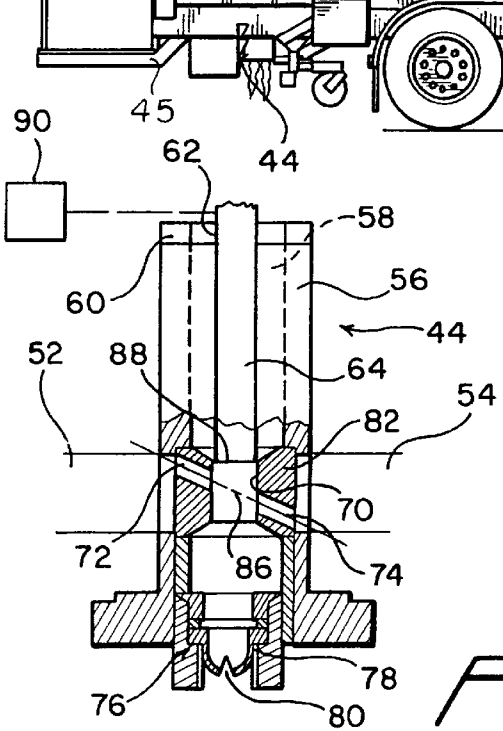
FIG. 3 is a partially sectional view of the spray gun for the spray system of FIG. 2.

With reference to FIGS. 2, 3 and 4, the spray gun 44 is fed with resin from the resin filter 50 by a resin input line 52 while catalyst from the catalyst filter 42 is provided to the spray gun by a catalyst input line 54. The spray gun includes an outer housing 56 which defines an internal housing chamber 58 having an upper end which is closed by a spray gun top wall 60. This spray gun top wall has a central opening 62 which receives a sliding shut off needle 64. Communicating with the central opening 62 within the housing chamber is a needle guide 66 for the shut off needle 64. The needle guide is mounted on the outer housing by a spider assembly 68.

Mounted beneath the housing chamber within the outer housing 56 is a mixing chamber 70 formed from a high wear resistance material, such as carbide, to resist the erosive characteristics of the abrasive resins which travel therethrough at a high pressure and speed. The mixing chamber includes a resin input orifice 72 and a catalyst input orifice 74 which are precision manufactured to tolerances within 0.0003 inch to maintain the accuracy of the catalyst-resin mix. It should be noted that the catalyst and resin input lines are much larger in diameter than the diameter of the resin and catalyst input orifices so that catalyst and resin which are fed at high pressure (i.e., 2500+ p.s.i.) through the input lines atomize as they pass through the small input orifices into the mixing chamber.

Mounted below the mixing chamber 70 is a nozzle assembly 76 which includes a spray tip 78 of abrasive resistant material such as carbide. The spray tip includes a spray opening 80 which is sized in relationship to the resin input orifice 72 and the catalyst input orifice 74 to ensure that a back pressure exists ahead of the spray tip 78 to cause mixing under pressure in the mixing chamber 70 so that thoroughly mixed material exits the spray gun. Thus, for example, the diameter of the resin input orifice 72 may be 0.049 inch, that of the catalyst orifice 74 may be 0.047 inch, while the diameter of the spray opening may be 0.072 inch. The inside diameter of the resin and catalyst input lines 52 and 54 may be ½ or ¾ inches.

The resin and catalyst input orifices 72 and 74 are actually small channels extending through the wall 82 of the mixing chamber 70 to connect the mixing chamber with the resin and catalyst input lines 52 and 54. The diameter of the mixing chamber is precisely fitted to the outer diameter of the shut off needle 64 so that the shut off needle will slide within the mixing chamber but will prevent seepage of the resin and catalyst mixture around the needle.

The catalyst and resin input orifices enter the mixing chamber 70 from opposite sides in directly opposed relationship, and at the entry points are offset, with the entry point for the catalyst being closer to the nozzle assembly 76 than the entry point for the resin. To accomplish this and still have the input orifices directly opposed at the entry to the mixing chamber, the channels forming the input orifices for the resin and catalyst are inclined so that the same central longitudinal axis 86 passes through both.

In an open position shown in FIG. 3, the shut off needle 64 closes the top of the mixing chamber 70 to permit resin and catalyst to mix within the mixing chamber. To terminate the provision of the resin and catalyst mixture from the nozzle assembly 76, the shutoff needle moves toward the nozzle assembly to first close the resin input orifice 72 and to subsequently close the catalyst input orifice 74. Conversely, to initiate the operation of the spray gun 44, the shutoff needle moves away from the nozzle assembly to first open the catalyst input orifice 74 and to subsequently open the resin input orifice 72. The first thing to exit the spray gun when operation is initiated and the last thing to exit the spray gun when operation is terminated is a small amount of catalyst without resin, which will not show on the surface being coated. Thus catalyst will coat the spray tip 78 when operation terminates and catalyst is the first material through the spray tip when operation is reinitiated, thereby insuring that the spray opening 80 will remain open. Also, when operation of the spray gun is terminated or reinitiated, there can never be resin only exiting from the spray tip at the start or end of a sprayed line which would leave an uncured spot or defect in the line. Resin with no catalyst will track and deform, while the spray gun of the present invention will provide a square end at the start and finish of a line. The spray gun 44 is heated by a suitable heating unit 92, which can constitute an electric heater, to maintain temperature control up to the exit of the sprayed material. Material temperature control is extremely important throughout the system, for it is platform at the rear end with a control console 16 for the system 10. A frame 6 extends above the support platform behind the console 16 and a pivoted sign 8 is secured adjacent to the top of the frame. The plural component striping spray system 10 includes an insulated resin material tank 18 and an insulated catalyst tank 20. The terms "resin" and "catalyst" are used herein for descriptive purposes to describe the many types of components which can be combined to form a two component striping composition, such as polyisocyanates which react with polyols. If retro reflective media are used, they are provided in a tank 21. The resin and catalyst tanks are externally heated by a heat exchange medium, such as glycol, provided by a heat generator 22. This heat generator may include a furnace, boiler or other device with a heat source to heat a heat exchange medium which is then pumped by a pump 24 to system components to be heated. Heated glycol is pumped by the pump 24 over an output line 26 to heat exchangers (not shown) surrounding the resin tank 18 and the catalyst tank 20 and is then returned to the heat generator 22 for reheating by a return line 28. Also, heated glycol is provided by the pump 24 to a catalyst heat exchanger 30 and a resin heat exchanger 32 over a heat exchanger output line 34. After the glycol gives up heat in the heat exchangers 30 and 32, it is returned to the heat generator for reheating over a heat exchanger return line 36.

To permit an operator to monitor the condition of the catalyst and resin, a recirculation system indicated generally at 94 is provided to monitor the condition of the catalyst and resin and then recirculate this monitored material back to the tanks 18 and 20 and the heat exchangers 30 and 32. Thus, no material is wasted.

The recirculation system is actually a spray simulator duplicating the heat, pressures and flows that would exist in actual spraying. When the shutoff needle 64 closes down the spray gun 44 with the resin pumps 46 and the catalyst pump 38 in operation, valves 93 and 95 are opened and the resin is passed over a recirculation line 96 to a restrictor orifice 98 and the catalyst is passed over a recirculation line 100 to a restrictor orifice 102. From the restrictor orifice 98, the resin returns over return line 99 to mix with the resin in the tank 18 and heat exchanger 32 while the catalyst return over return line 103 to mix with the catalyst in the tank 20 and the heat exchanger 30.

Figure 5:
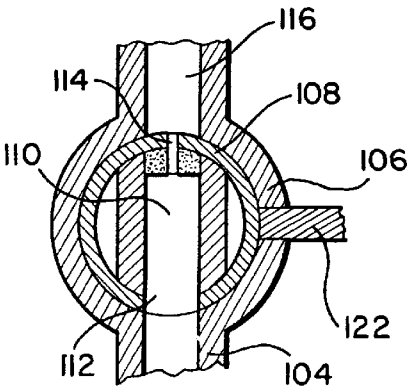
FIG. 5 is a sectional view of a restrictor orifice for the recirculation system of FIG. 2.

The restrictor orifices 98 and 102 include the same construction which will be described in connection with FIG. 5. Each orifice includes an input recirculation line 104 from one of the valves 93 or 95 which opens into a ball valve housing 106. Within the ball valve housing is a rotatable ball valve 108 with an internal channel 110 having an end which opens at 112 into the input line 104. The input line 104 and the channel 110 duplicate in size the spray gun input lines 52 and 54. The end of the channel 110 opposite to the opening 112 has an output orifice 114 which corresponds in size to either the resin input orifice 72 or the catalyst input orifice 74. This output orifice 114 opens into an output line 116 which corresponds to one of the return lines 99 or 103.

Thus, the restrictor orifices 98 and 102 duplicate the spray gun input orifices 72 and 74 and the condition of the resin and catalyst at the respective restrictor orifices duplicates that at the inputs to the spray gun 44. When the spray gun is shut down by the shut off needle 64, the valves 93 and 95, which can be solenoid operated valves controlled from the control console 16, can be opened to recirculate and permit monitoring of parameters of the resin and catalyst. By measuring the pressure of the resin at a monitor 118 and the catalyst at a monitor 120, the relative viscosity of the two can be determined and the temperature of one or both can be varied until the viscosities are substantially equal. The temperature of the catalyst and resin can also be separately monitored at the monitors 118 and 120.

The resin and catalyst are lower in temperature and more viscous when the system 10 has been shut down, but as they are forced through the recirculation system, they heat up and become less viscous. When the desired ratio of resin to catalyst is achieved, the pressure of the resin at the restrictor orifice 98 will be equal to the pressure of the catalyst at the restrictor orifice 102 if their viscosities are equal.

To maintain the desired ratio of resin and catalyst in the mixing chamber of the spray gun, each must be separately heated and they must be maintained at a temperature differential where their viscosities are substantially equal. Once this equal viscosity is obtained, the operator shuts down the recirculation system by closing the valves 93 and 95 and then activates the spray gun 44 by operation of the needle drive 90 from the control console. The operator will monitor the viscosities using the recirculation system without wasting resin or catalyst.

When contaminants exist in the materials, passage through the restrictor orifices 98 and 102 can result in clogging of the orifice. When this occurs, an orifice can be cleared by rotating the ball valve 108 within the ball valve housing 106 to align the output orifice 114 with the input line 104 so that the pressure in the input line clears the output orifice. The ball valve is rotated by a shaft 122 which can be manually rotated or rotated by an electrical actuator (not shown).

The temperature of the heat exchange material provided to the resin tank 18 and resin heat exchanger 32 can be varied from the control console 16 by means of suitable temperature controllers (not shown). Also heated agitator paddles 124 are provided which rotate within the resin material tank 18, and heated agitator paddles 126 are provided which rotate within the catalyst material tank 20. These agitator paddles include electrical heating coils which are powered from power supplies 128 and 130, and these power supplies can be varied from the control console to control the temperature of the material within the respective material tanks. Other alternate means of heating the paddles or the interior of the material in the tank, such as glycol tubes or other heat exchange tubes can be used.

It is important to exclude moisture from many catalysts which foam or otherwise react when subjected to water, and consequently the catalyst material tank 20 may be pressurized from a source 132 with an inert gas such as nitrogen. Also, gas, compressed air or other inert material from a source 134 may be provided by a control valve 136 activated from the control console to purge the spray gun 44.

The plural component striping spray system 10 has been shown with only one spray gun 44, but the system can feed a plurality of spray guns for the formation of plural lines. Each of the plural spray guns would be provided with its own recirculation system 94. When plural spray guns are used, it is possible to mount the guns on a controlled, movable base to translate a gun along an x, y and z axis to form letters and other indicia.

Industrial Applicability

The plural component striping spray system 10 operates effectively to produce a clear, sharp, uniform line with no distortion. Two components used in the system are mixed by impingement and carefully monitored without material waste. The spray gun orifice is prevented from clogging by terminating resin flow before catalyst flow and by initiating catalyst flow before resin flow. A recirculation system permits material condition to be monitored without material waste, and recirculation system orifices are reversible to clear clogs.

We claim:

1. A plural component spray striping vehicle comprising a vehicle operator's cab positioned at a forward end of the vehicle, a support platform extending from said vehicle operator's cab to a rear end of the vehicle, a spray operator's console mounted on said support platform adjacent to the rear end of said vehicle, a first storage assembly for storing a first liquid spray component, said first storage assembly including a storage tank for said first liquid spray component mounted on said support platform between said vehicle operator's cab and said spray operator's console, and an agitator paddle mounted for rotation in the storage tank for said first liquid spray component, a second storage assembly for storing a second liquid spray component, said second storage assembly including a storage tank for said second liquid spray component mounted on said support platform between said vehicle operator's cab and said spray operator's console, and an agitator paddle mounted for rotation in the storage tank for said second liquid spray component, an impingement spray gun mounted on said support platform beneath said spray operator's console adjacent to the rear end of said vehicle, said impingement spray gun operating upon simultaneously receiving said first and second liquid spray components to mix said first and second liquid spray components by impingement, a heating unit connected to said impingement spray gun, a first transfer assembly for providing said first liquid spray component under pressure to said impingement spray gun from said first storage assembly, a second transfer assembly for providing said second liquid spray component under pressure to said impingement spray gun from said second storage assembly, and a temperature control assembly connected to control the temperature of said first and second transfer assemblies.

2. The plural component spray striping vehicle of claim 1 wherein a rear platform is mounted on the underside of said support platform to extend outwardly beyond the rear end of said vehicle below the level of said support platform and behind said spray operator's console, said rear platform being positioned to extend outwardly from an area between said airless impingement spray gun and the rear end of said vehicle.

3. The plural component spray striping vehicle of claim 2 wherein a frame is secured to extend upwardly above said support platform behind said spray operator's console.

4. The plural component spray striping vehicle of claim 3 wherein a container for reflective media is mounted on said support platform between said vehicle operator's cab and said spray operator's console.

5. The plural component spray striping vehicle of claim 4 wherein an agitator heating unit is attached to heat said agitator paddles.

6. The plural component spray striping vehicle of claim 5 wherein a heater assembly is provided to heat the storage tanks for said first and second liquid spray components.

7. The plural component spray striping vehicle of claim 6 wherein a temperature control assembly is provided to control the temperature of said first and second transfer assemblies.

8. The plural component spray striping vehicle of claim 7 wherein said first and second transfer assemblies each include an accumulator between the pump for said transfer assembly and said airless impingement spray gun.

9. The plural component spray striping vehicle of claim 7 wherein a heating unit is connected to heat said impingement spray gun.

10. A plural component spray striping vehicle comprising a vehicle operator's cab positioned at a forward end of the vehicle, a support platform extending from said vehicle operator's cab to a rear end of the vehicle, a spray operator's console mounted on said support platform adjacent to the rear end of said vehicle, a first storage assembly for storing a first liquid spray component, said first storage assembly including a storage tank for said first liquid spray component mounted on said support platform between said vehicle operator's cab and said spray operator's console, a second storage assembly for storing a second liquid spray component which is different from said first liquid spray component, said second storage assembly including a storage tank for said second liquid spray component mounted on said support platform between said vehicle operator's cab and said spray operator's console, an impingement spray gun mounted on said support platform beneath said spray operator's console adjacent to the rear end of said vehicle, said impingement spray gun operating upon simultaneously receiving said first and second liquid spray components to mix said first and second liquid spray components by impingement, a first transfer assembly for providing said first liquid spray component under pressure to said impingement spray gun from said first storage assembly, and a second transfer assembly for providing said second liquid spray component under pressure to said impingement spray gun from said second storage assembly, said first and second transfer assemblies each includes a pumping assembly to pump one of said first or second liquid spray components under pressure to said impingement spray gun, the pumping assembly of one of said first of a second transfer assemblies operating to pump a greater volume of liquid spray component to said impingement spray gun that does the pumping assembly in the remaining transfer assembly to create a ratio between the first and second liquid spray components at said impingement spray gun;

wherein a heating unit is connected to heat said impingement spray gun and a heater assembly is provided to heat said first and second transfer assemblies and said first and second storage tanks.

* * * * *